US007025291B2

(12) United States Patent
Wu

(10) Patent No.: US 7,025,291 B2
(45) Date of Patent: Apr. 11, 2006

(54) WATER SPRAYER HAVING WATER CONTROL DEVICE

(76) Inventor: Sheng Li Wu, 7F-3, No. 1, Shi Fu Road, Taichung (TW) 403

( * ) Notice: Subject to any disclaimer, the term of this patent is extended or adjusted under 35 U.S.C. 154(b) by 80 days.

(21) Appl. No.: 10/897,944

(22) Filed: Jul. 26, 2004

(65) Prior Publication Data

US 2005/0001070 A1 Jan. 6, 2005

Related U.S. Application Data

(63) Continuation-in-part of application No. 10/436,410, filed on May 8, 2003, now abandoned.

(51) Int. Cl.
*B05B 7/02* (2006.01)

(52) U.S. Cl. ..... 239/526; 239/525; 239/569; 239/581.1; 239/581.2

(58) Field of Classification Search ..... 239/526, 239/525, 527, 124, 569, 581.1, 581.2, 582.1, 239/583

See application file for complete search history.

(56) References Cited

U.S. PATENT DOCUMENTS

| | | | | |
|---|---|---|---|---|
| 2,416,719 | A * | 3/1947 | Stockdale | 239/480 |
| 3,765,607 | A * | 10/1973 | Pacht | 239/124 |
| 4,483,483 | A * | 11/1984 | Grime | 239/526 |
| 6,390,390 | B1 * | 5/2002 | Hung | 239/525 |
| 6,702,206 | B1 * | 3/2004 | Wu | 239/526 |

* cited by examiner

*Primary Examiner*—Dinh Q. Nguyen
(74) *Attorney, Agent, or Firm*—Charles E. Baxley

(57) ABSTRACT

A water sprayer includes a handle having a passage, a housing having a pathway and a chamber communicating with the passage and a passageway communicating with the chamber and the pathway of the housing, to form a valve seat between the passageway and the pathway of the housing. A stem is rotatably and slidably received in the passageway and the chamber of the housing, and includes a block having a groove for selectively communicating with the passage of the handle. The block includes a channel formed by a swelling and having an opening selectively communicating with the pathway of the housing when the stem is rotated relative to the housing, to control a water flowing through the housing.

7 Claims, 7 Drawing Sheets

WATER SPRAYER HAVING WATER CONTROL DEVICE

The present invention is a continuation-in-part of U.S. patent application Ser. No. 10/436,410, filed 8 May 2003, to be abandoned.

BACKGROUND OF THE INVENTION

1. Field of the Invention

The present invention relates to a water sprayer, and more particularly to a water sprayer having a water control device to control water flowing through the water sprayer, and to allow the water to flow out of the water sprayer in different flowing speed or quantity.

2. Description of the Prior Art

Typical water sprayers comprise a housing disposed or provided on top of a handle, and a control ferrule attached to front portion of the housing, in order to control or to form various water spraying patterns. The handle is coupled to a water supplier or water reservoir, to receive water, and to allow the water to flow out through the control ferrule.

However, normally, the handle is directly coupled to the water supplier or water reservoir, and has no control device disposed or coupled between the handle and the water supplier or water reservoir, such that the water flowing from the water supplier to the handle may not be controlled or adjusted, or the water flowing out through the control ferrule or the housing also may not be controlled or adjusted.

The present invention has arisen to mitigate and/or obviate the afore-described disadvantages of the conventional water sprayer devices.

SUMMARY OF THE INVENTION

The primary objective of the present invention is to provide a water sprayer including a water control device to control water flowing through the water sprayer, and to allow the water to flow out of the water sprayer in different flowing speed or quantity.

In accordance with one aspect of the invention, there is provided a water sprayer comprising a handle including a passage formed therein, for coupling to water reservoir, a housing provided on top of the handle, and including a pathway formed therein, the housing including a chamber formed therein and communicating with the passage of the handle, and including a passageway formed therein and communicating with the chamber and the pathway of the housing, to form a valve seat between the passageway and the pathway of the housing, a stem rotatably and slidably received in the passageway and the chamber of the housing, and including a front end extendible out through the housing, and including a rear end, and including a block provided thereon and having a groove formed therein for selectively communicating with the passage of the handle when the stem moves rearwardly relative to the housing, and for being selectively offset from the passage of the handle when the stem moves forwardly relative to the housing. The block includes a channel formed therein and defined by a swelling, and communicating with the groove thereof, and having an opening selectively communicating with the pathway of the housing when the stem is rotated relative to the housing, in order to control a water flowing through the pathway of the housing. The swelling of the stem is rotatable relative to the valve seat of the housing, to control the water flowing from the passageway to the pathway of the housing, and to allow the water to flow out through the pathway of the housing in different flowing quantity. A hand grip is pivotally attached to the housing, and engageable with the front end of the stem, to selectively move the front end of the stem rearwardly relative to the housing when the hand grip is pulled toward the handle, and to allow the front end of the stem to move out through the front hole of the housing when the hand grip is released. A spring biasing device may further be provided for biasing the stem forwardly relative to the housing, to disengage the groove of the block from the passage of the handle, and a knob may further be provided and attached to the rear end of the stem, to rotate the stem relative to the housing, and to rotate the swelling of the stem relative to the valve seat of the housing.

The passageway of the housing includes a front hole formed therein, to slidably receive the front end of the stem. The groove of the block is perpendicular to or inclined relative to the block of the stem. The channel of the block is preferably parallel to the block of the stem.

The block includes a curved recess formed therein and defined by the swelling, the housing includes a projection extended into the passageway thereof, and slidably received in the curved recess of the block, to limit the stem to rotate relative to the housing.

The housing includes a cap attached thereto, to block the chamber thereof, a barrel slidably received in the chamber thereof and attached to the rear end of the stem, to allow the stem to be rotated in concert with the barrel, the biasing device includes a spring engaged between the barrel and the block.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
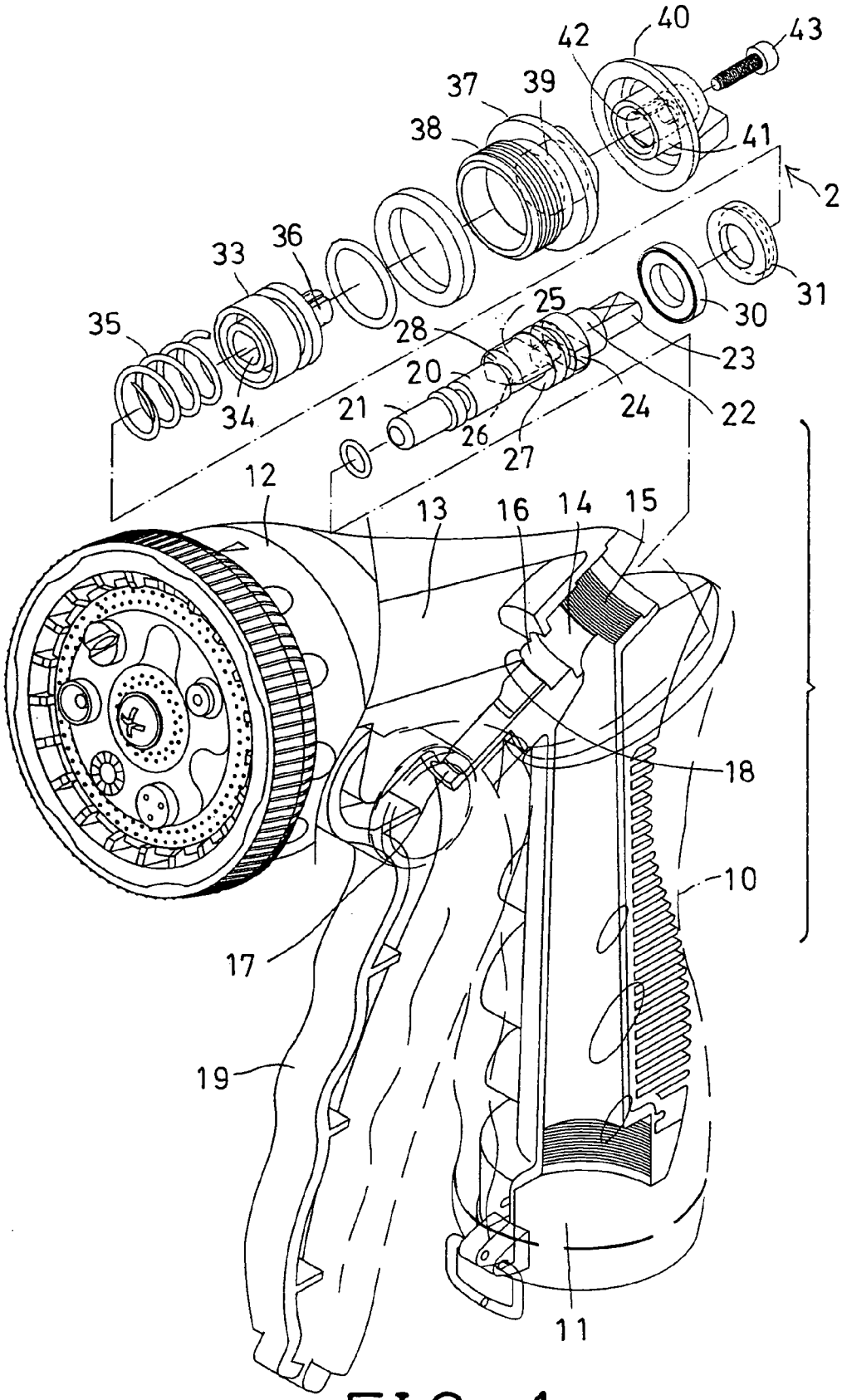
FIG. 1 is an exploded view of a water sprayer in accordance with the present invention.
Figure 2:
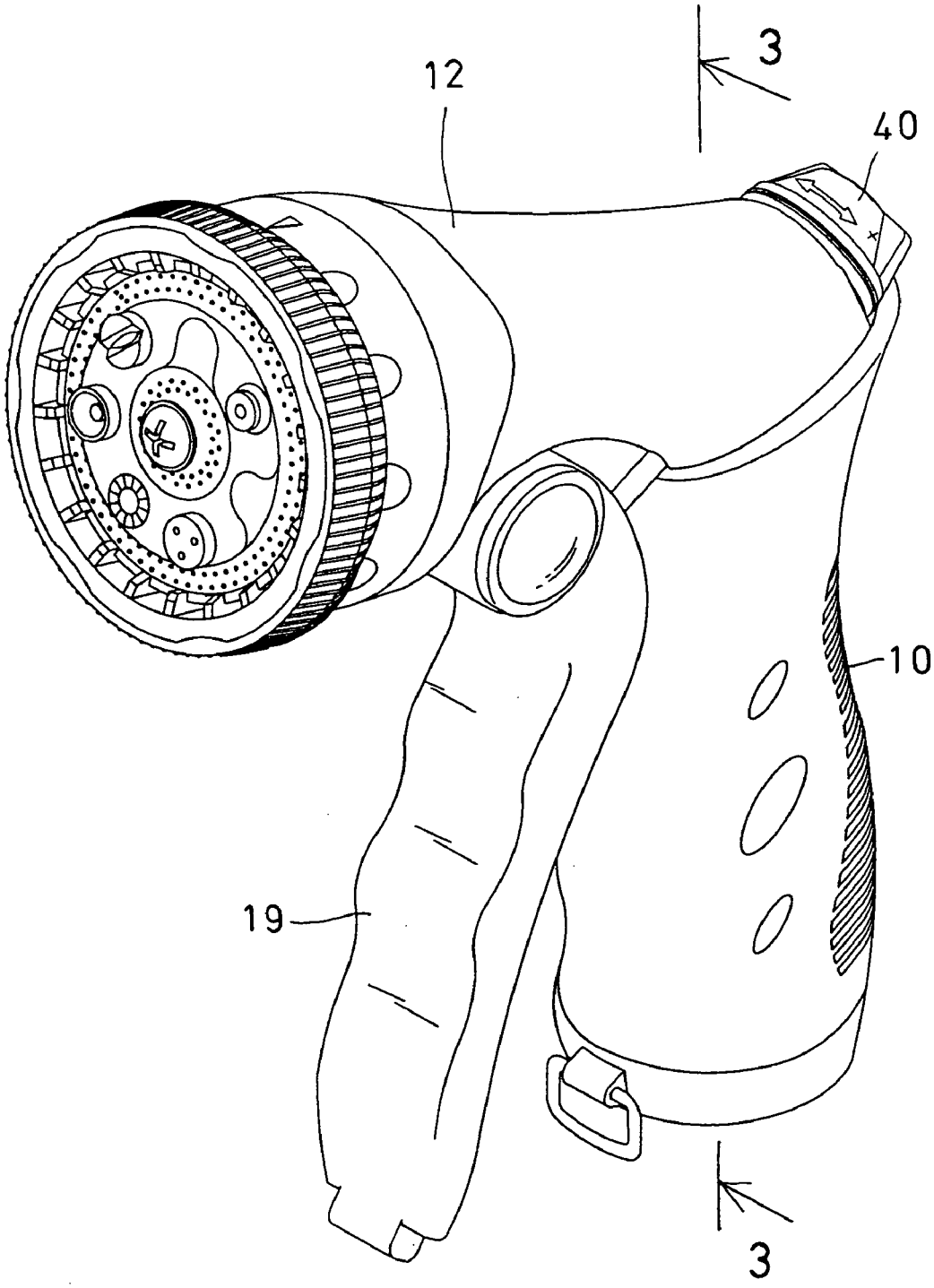
FIG. 2 is a perspective view of the water sprayer.
Figure 3:
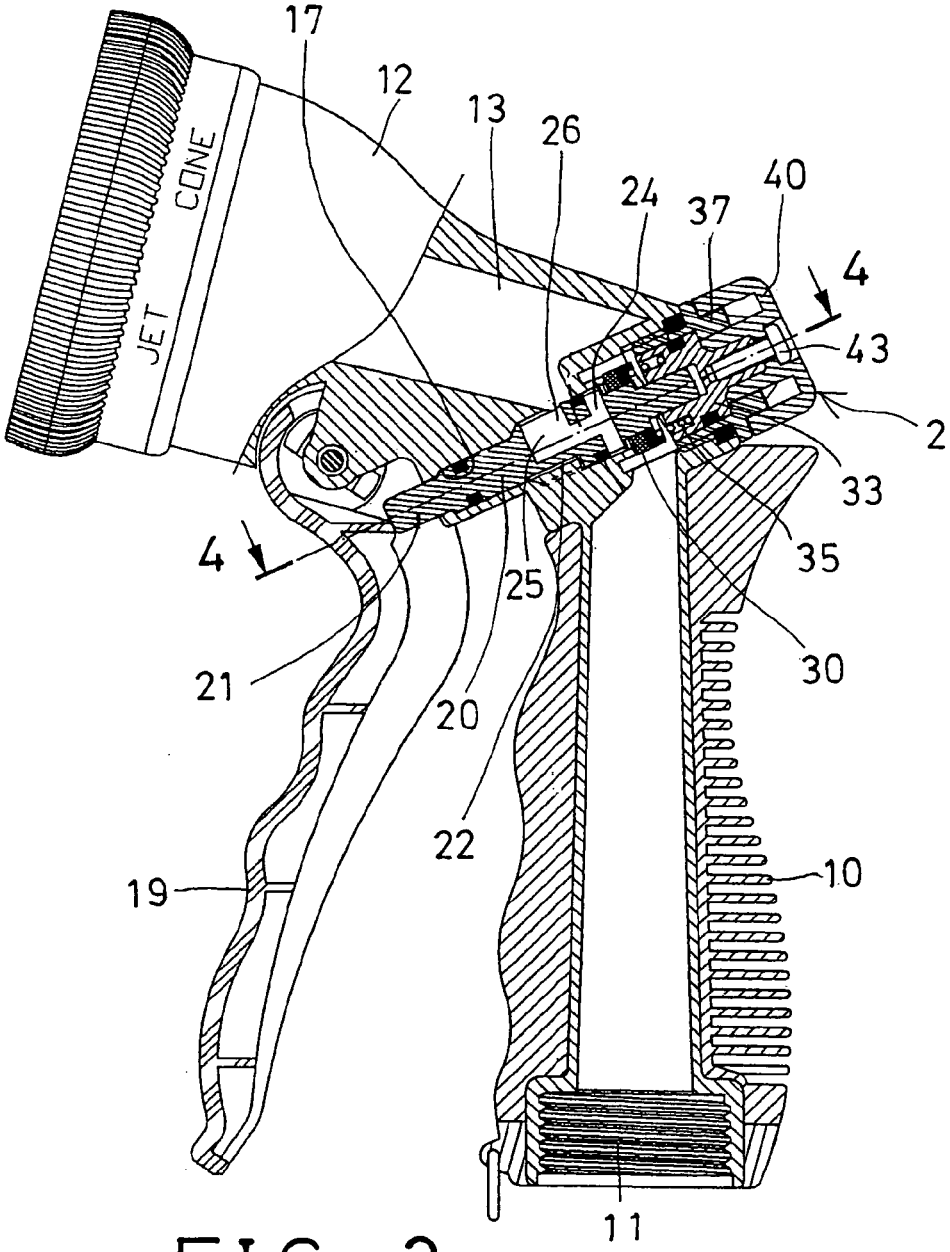
FIG. 3 is a partial cross sectional view of the water sprayer, taken along lines 3—3 of FIG. 2.
Figure 4:
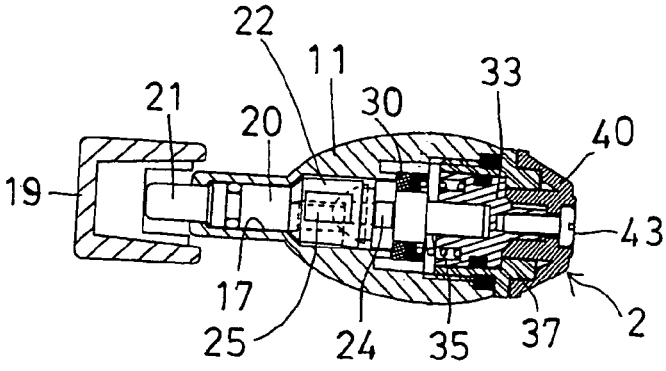
FIG. 4 is a partial cross sectional view taken along lines 4—4 of FIG. 3.
Figure 5:
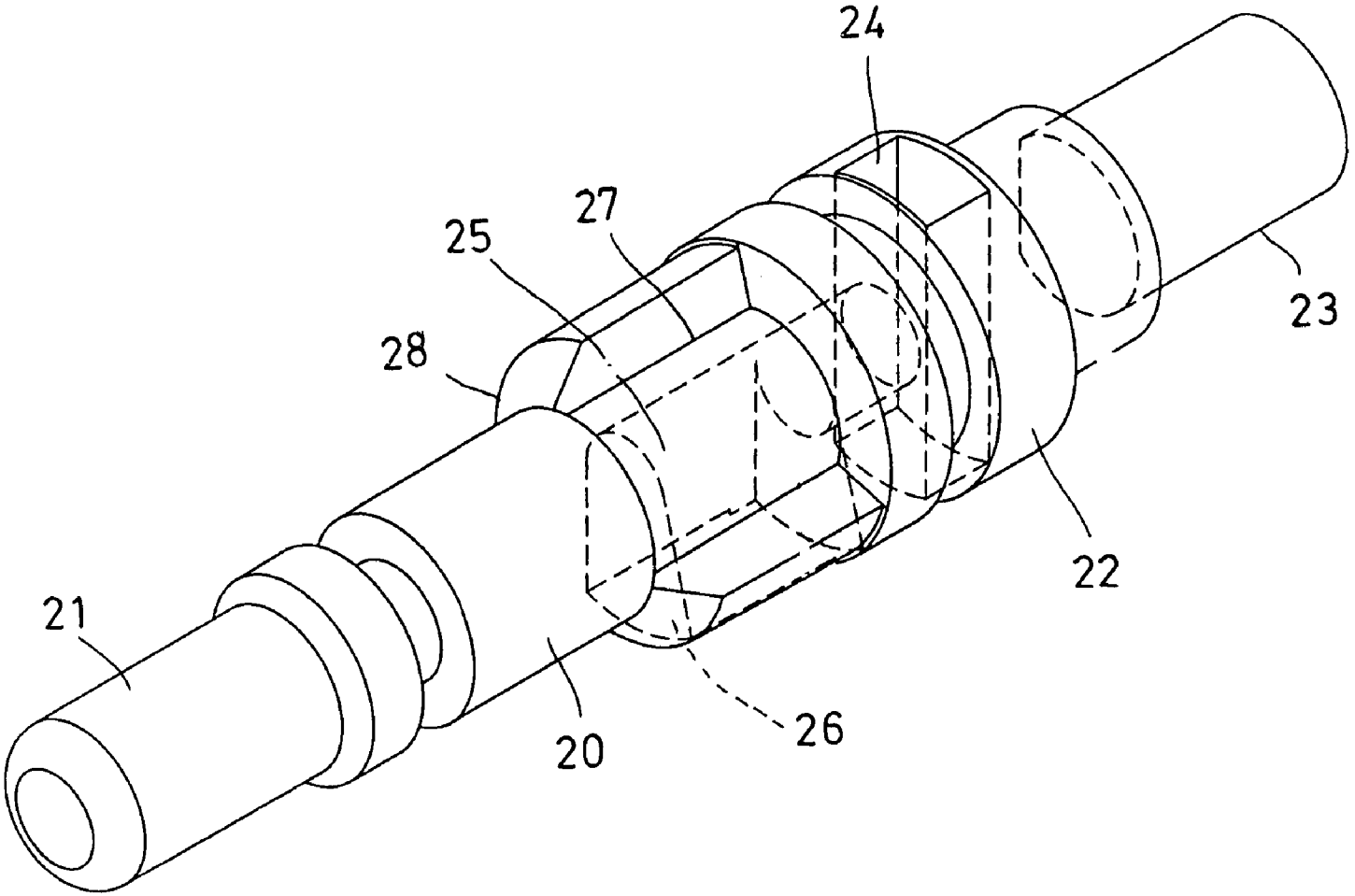
FIG. 5 is a perspective view illustrating a stem of a control device for the water sprayer.
Figure 8:
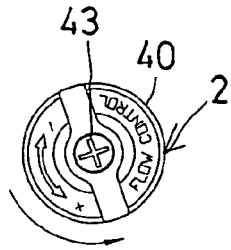
FIG. 8 is an end view of the control device for the water sprayer.

Referring to the drawings, and initially to FIGS. 1–3, a water sprayer in accordance with the present invention comprises a handle 10 including a passage 11 formed or provided therein, for coupling to a water supplier or water reservoir, to receive water therefrom, and to allow the water to flow into the handle 10, and a housing 12 disposed or provided on top of the handle 10 and including a pathway 13 formed or provided therein, for allowing the water to flow out through the housing 12.

Figure 7:
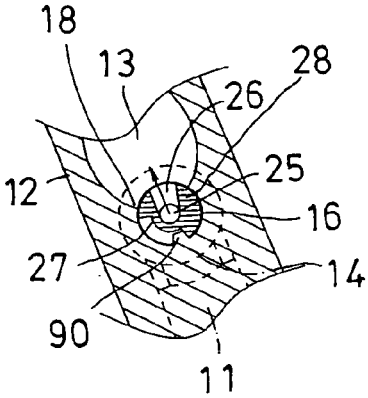
FIG. 7 is a partial cross sectional view taken along lines 7—7 of FIG. 6.
Figure 10:
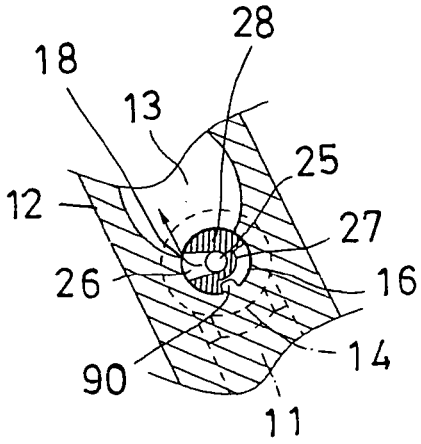
FIG. 10 is a partial cross sectional view taken along lines 10—10 of FIG. 9.

The housing 12 includes a chamber 14 formed or provided in the rear portion thereof, and communicating with the passage 11 of the handle 10, and having an inner thread 15 formed therein, and includes a passageway 16 formed or provided in the middle portion thereof, and communicating with the pathway 13 and the chamber 14 of the housing 12, and to form a valve seat 18 between the passageway 16 and the pathway 13 of the housing 12 (FIGS. 1, 7, 10). The passageway 16 of the housing 12 includes a front hole 17 formed therein and opened forwardly through the housing 12.

A control device 2 includes a stem 20 rotatably and slidably received in the chamber 14 and the passageway 16 of the housing 12, and having a front end 21 extended out through the front hole 17 of the housing 12, and having a block 22 extended or provided in the middle portion thereof, and having a rear end 23 rotatably and slidably received in the chamber 14 of the housing 12. The block 22 includes an outer diameter greater than that of the stem 20, and is rotatably and slidably received in or between the chamber 14 and the passageway 16 of the housing 12.

Figure 6:
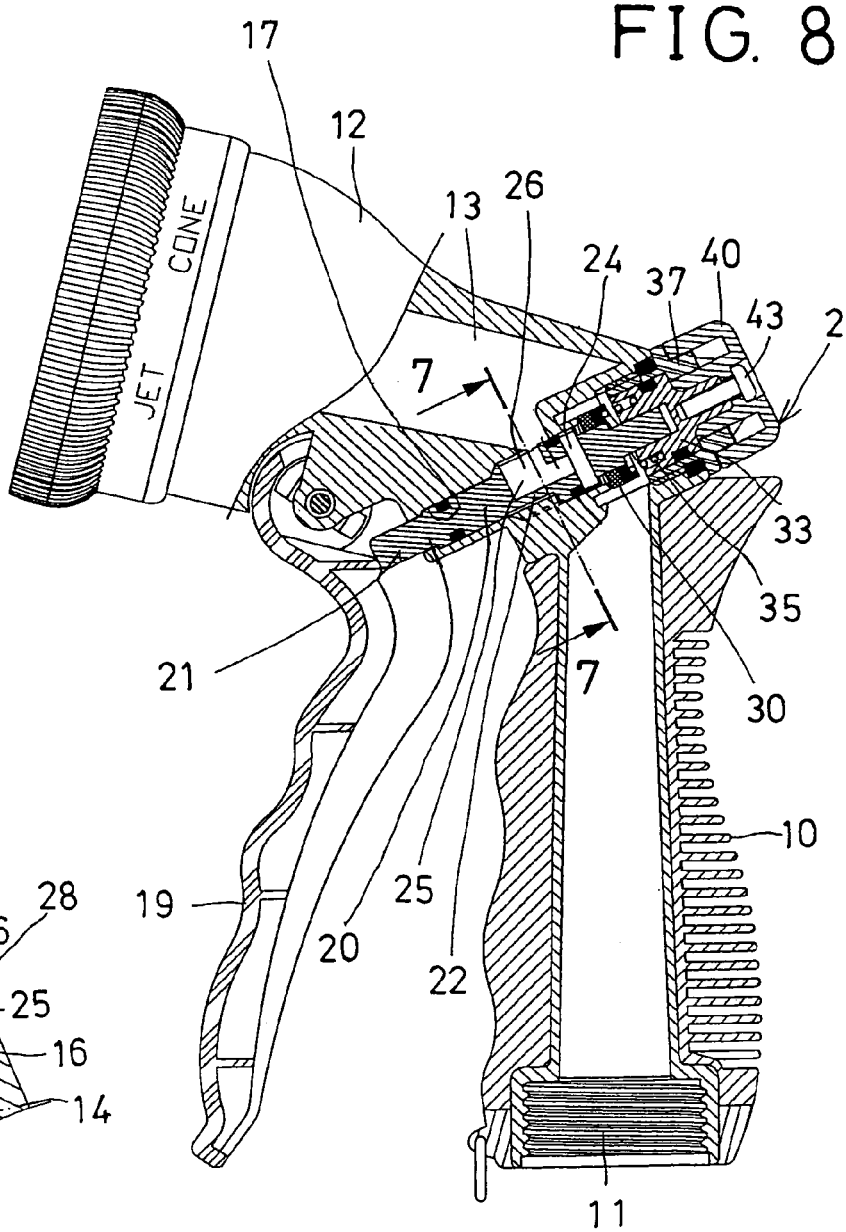
FIG. 6 is a partial cross sectional view similar to FIG. 3, illustrating the operation of the water sprayer.
Figure 9:
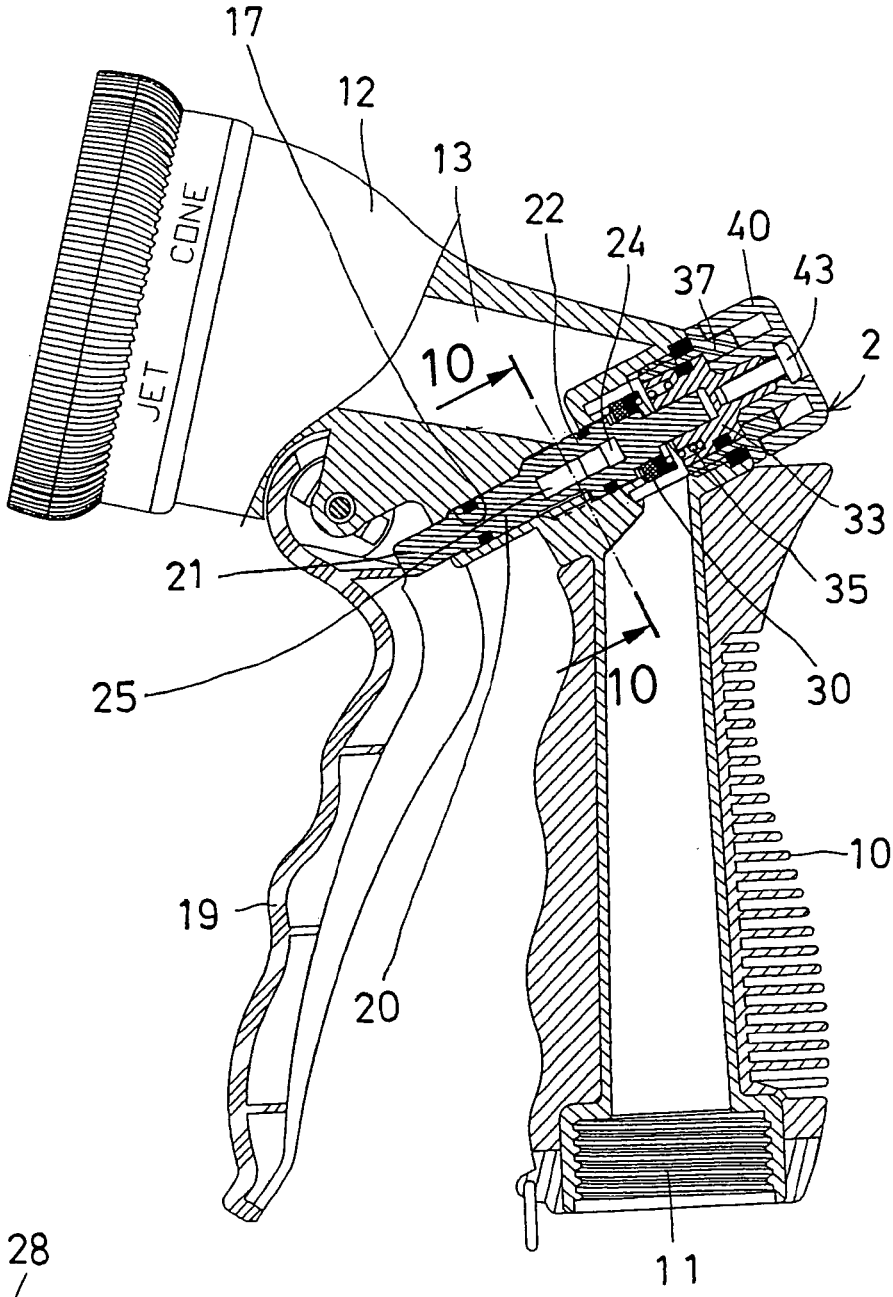
FIG. 9 is a partial cross sectional view similar to FIGS. 3 and 6, illustrating the operation of the water sprayer.

The block 22 of the stem 20 includes a groove 24 formed therein and perpendicular or inclined relative to the block 22 and/or the stem 20 (FIGS. 1 and 3–5), for selectively communicating with the passage 11 of the handle 10 when the stem 20 moves rearwardly relative to the housing 12 (FIG. 11), and for being selectively offset from the passage 11 of the handle 10 when the stem 20 moves forwardly relative to the housing 12 (FIGS. 3, 6, 9).

A hand grip 19 is pivotally attached to the handle 10 or to the housing 12, and is engageable with the front end 21 of the stem 20, to move the front end 21 of the stem 20 into or rearwardly relative to the housing 12 when the hand grip 19 is pulled or moved toward the handle 10, or to allow the front end 21 of the stem 20 to move out through the front hole 17 of the housing 12 when the handgrip 19 is released or moved away from the handle 10.

The block 22 of the stem 20 further includes a channel 25 formed therein and defined by a curved swelling 28, and preferably parallel to the block 22 and/or the stem 20 (FIGS. 1 and 3–5), and communicating with the groove 24 thereof, and having an opening 26 selectively communicating with the pathway 13 of the housing 12 (FIGS. 6–7 and 9–10) when the stem 20 is rotated relative to the housing 12 (FIGS. 7, 10), in order to control the water flowing out through the pathway 13 of the housing 12 in different flowing speed and/or quantity.

The block 22 of the stem 20 further includes a curved recess 27 formed therein and also defined by the curved swelling 28, in which the swelling 28 may be moved relative to the pathway 13 and the passageway 16 and the valve seat 18 of the housing 12 (FIGS. 7, 10), in order to control the water flowing from the passageway 16 to the pathway 13 of the housing 12, and to allow the water to flow out through the pathway 13 of the housing 12 in different flowing quantity.

The housing 12 further includes a projection 90 extended into the passageway 16 thereof (FIGS. 7, 10), and extended into or slidably received in the curved recess 27 of the block 22 or of the stem 20, in order to control or to limit the stem 20 to rotate relative to the housing 12, and to position the swelling 28 relative to the valve seat 18 of the housing 12, or to allow the opening 26 of the channel 25 of the block 22 or of the stem 20 in partially communicating with the pathway 13 of the housing 12 (FIG. 10), or in fully or completely communicating with the pathway 13 of the housing 12 (FIG. 7).

One or more washers or gaskets 30, 31 may be engaged onto the rear end 23 of the stem 20, and engaged with the housing 12, to make a water tight seal between the stem 20 and the housing 12, a barrel 33 is slidably received in the chamber 14 of the housing 12 and has a non-circular hole 34 formed therein to slidably receive the rear end 23 of the stem 20, and to allow the stem 20 to be rotated by or in concert with the barrel 33. A spring 35 is engaged between the barrel 33 and the block 22 or the gaskets 30, 31, to bias the stem 20 forwardly relative to the housing 12, and to force the front end 21 of the stem 20 to move out through the front hole 17 of the housing 12.

The barrel 33 includes a non-circular shank 36 extended rearwardly therefrom. A cap 37 includes an outer thread 38 formed thereon for threading with the inner thread 15 of the housing 12, to block the chamber 14 thereof, and includes an orifice 39 formed therein for receiving the shank 36 of the barrel 33. The cap 37 is engageable with the barrel 33, for rotatably retaining the barrel 33 within the chamber 14 of the housing 12.

A knob 40 includes a hub 41 extended into the orifice 39 of the cap 37 and having a non-circular aperture 42 formed therein, to receive the corresponding non-circular shank 36 of the barrel 33, and thus to allow the barrel 33 and thus the stem 20 to be rotated by or in concert with the knob 40. A fastener 43 may further secure the knob 40 to the barrel 33, to allow the barrel 33 and thus the stem 20 to be effectively rotated or driven by the knob 40.

In operation, as shown in FIGS. 6–10, the stem 20 may be rotated by the knob 40, to control the opening 26 of the channel 25 of the block 22 or of the stem 20 in partially communicating with the pathway 13 of the housing 12 (FIG. 10), or in fully or completely communicating with the pathway 13 of the housing 12 (FIG. 7), and thus to control or to adjust the water flowing way from the passage 11 of the handle 10 through the pathway 13 of the housing 12.

Figure 11:
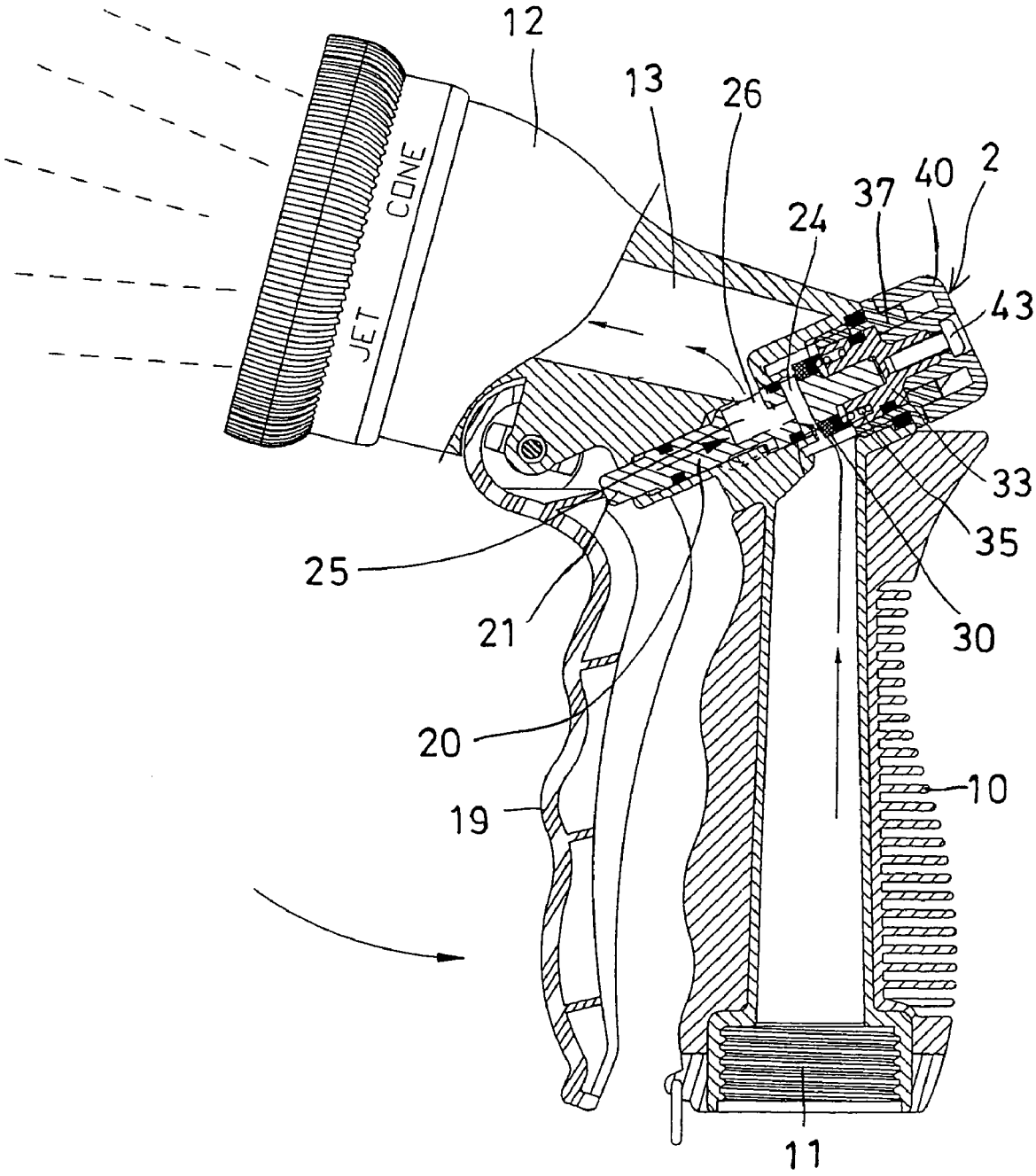
FIG. 11 is a partial cross sectional view similar to FIGS. 3, 6 and 9, illustrating the operation of the water sprayer.

As shown in FIG. 11, when the hand grip 19 is pulled or moved toward the handle 10 to force the front end 21 of the stem 20 to move into the front hole 17 of the housing 12, the groove 24 of the block 22 and/or of the stem 20 may be moved to be communicated with the passage 11 of the handle 10, to allow the water from the passage 11 of the handle 10 to flow through the groove 24 and the channel 25 of the stem 20, and then to flow out through the pathway 13 of the housing 12.

The groove 24 of the block 22 and/or of the stem 20 may be moved to be offset from the passage 11 of the handle 10 when the hand grip 19 is released or moved away from the handle 10, or when the stem 20 is moved or biased forwardly relative to the housing 12 by the spring 35, in order to stop or to block the water flowing way from the passage 11 of the handle 10 through the pathway 13 of the housing 12, and thus to prevent the water from flowing out through the pathway 13 of the housing 12.

Accordingly, the water sprayer in accordance with the present invention includes a water control device to control water flowing through the water sprayer, and to allow the water to flow out of the water sprayer in different flowing speed or quantity.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A water sprayer comprising:

a handle including a passage formed therein, for coupling to a water reservoir, a housing provided on top of said handle, and including a pathway formed therein, said housing including a chamber formed therein and communicating with said passage of said handle, and including a passageway formed therein and communicating with said chamber and said pathway of said housing, to form a valve seat between said passageway and said pathway of said housing, a stem rotatably and slidably received in said passageway and said chamber of said housing, and including a front end extendible out through said housing, and including a rear end, and including a block provided thereon and having a groove formed therein for selectively communicating with said passage of said handle when said stem moves rearwardly relative to said housing, and for being selectively offset from said passage of said handle when said stem moves forwardly relative to said housing, said block including a channel formed therein and defined by a swelling, and communicating with said groove thereof, and having an opening selectively communicating with said pathway of said housing when said stem is rotated relative to said housing, in order to control a water flowing through said pathway of said housing, said swelling of said stem being rotatable relative to said valve seat of said housing, to control the water flowing from said passageway to said pathway of said housing, and to allow the water to flow out through said pathway of said housing in different flowing quantity, a hand grip pivotally attached to said housing, and engageable with said front end of said stem, to selectively move said front end of said stem rearwardly relative to said housing when said hand grip is pulled toward said handle, and to allow said front end of said stem to move out through said front hole of said housing when said hand grip is released, means for biasing said stem forwardly relative to said housing, to disengage said groove of said block from said passage of said handle, and a knob attached to said rear end of said stem, to rotate said stem relative to said housing, and to rotate said swelling of said stem relative to said valve seat of said housing.

2. The water sprayer as claimed in claim 1, wherein said passageway of said housing includes a front hole formed therein, to slidably receive said front end of said stem.

3. The water sprayer as claimed in claim 1, wherein said groove of said block is perpendicular to said block of said stem.

4. The water sprayer as claimed in claim 1, wherein said groove of said block is inclined relative to said block of said stem.

5. The water sprayer as claimed in claim 1, wherein said channel of said block is parallel to said block of said stem.

6. The water sprayer as claimed in claim 1, wherein said block includes a curved recess formed therein and defined by said swelling, said housing includes a projection extended into said passageway thereof, and slidably received in said curved recess of said block, to limit said stem to rotate relative to said housing.

7. The water sprayer as claimed in claim 1, wherein said housing includes a cap attached thereto, to block said chamber thereof, a barrel slidably received in said chamber thereof and attached to said rear end of said stem, to allow said stem to be rotated in concert with said barrel, said biasing means includes a spring engaged between said barrel and said block.

* * * * *